United States Patent [19]

Suchan

[11] 4,378,044

[45] Mar. 29, 1983

[54] PROCESS OF FORMING CASTING MOLD FOR CAST PIECES HAVING AT LEAST ONE UNDERCUT

[75] Inventor: Günther Suchan, Burscheid, Fed. Rep. of Germany

[73] Assignee: Goetze AG, Burscheid, Fed. Rep. of Germany

[21] Appl. No.: 193,726

[22] Filed: Oct. 3, 1980

[30] Foreign Application Priority Data

Oct. 4, 1979 [DE] Fed. Rep. of Germany ..... 2940171

[51] Int. Cl.[3] ..... B22C 7/00; B22C 9/22

[52] U.S. Cl. ..... 164/40; 164/44; 164/245

[58] Field of Search ..... 164/15, 40, 44, 45, 164/245

[56] References Cited

U.S. PATENT DOCUMENTS 3,552,480 1/1971 Harris ..... 164/245

3,570,585 3/1971 Harris ..... 164/245

FOREIGN PATENT DOCUMENTS 1362346 8/1974 United Kingdom .

435047 11/1974 U.S.S.R. ..... 164/45

*Primary Examiner*—Gus T. Hampilos

*Assistant Examiner*—J. Reed Batten, Jr.

*Attorney, Agent, or Firm*—Spencer and Kaye

[57] ABSTRACT

A mold forming tool for use in the manufacture of casting molds by compression of loose mold forming material by a process in which the final compacting is achieved by pressing, for the casting of cast pieces having undercuts, the tool having an elastically deformable portion in the region of the undercuts, and the elastically deformable portion being made of a material which is deformable, thus creating the undercut pattern, solely under the influence of the pressure exerted on the mold forming material during the final compacting.

4 Claims, 4 Drawing Figures

PROCESS OF FORMING CASTING MOLD FOR CAST PIECES HAVING AT LEAST ONE UNDERCUT

BACKGROUND OF THE INVENTION

The present invention relates to a mold forming tool or pattern for the manufacture of casting molds from loose molding materials by one of the well known mold making processes in which the final compacting is achieved by pressing, the molds being used for casting of pieces presenting undercuts, especially annular objects such as slide- and/or counter-rings of axial face seals, the tool being elastically deformable in the region of the undercuts.

Molds for the production of cast pieces having undercuts can not as of the present be manufactured by simple compression molding processes. Such molds are therefore manufactured according to relatively complicated shaping procedures, such as, for example, the lost wax casting process, casting using lost patterns, or utilizing casting molds with inserted cores. Undercuts may also subsequently be ground out of rough castings.

For example, an axial face seal, at the upper rim of its outer circumference, includes, as an undercut, an annularly extending support collar for an elastic O-ring. The support collar is formed by grinding out a rough casting which has accordingly been cast to initially be larger than the desired finished size.

This manner of producing articles with undercuts is very laborious and expensive. Additional tools, to some extent expensive materials and time-consuming process steps are required, so that especially such articles can not be economically mass produced.

U.S. Pat. No. 3,570,585 discloses patterns for the production of casting molds made by a cold or heated process and provided with a back draft portion in the region where an undercut is to be produced. In this case, the pattern includes, in the region of the undercut to be formed, an elastic edge portion having a shape corresponding to the undercut when the portion is in its unstressed rest condition. During withdrawal of the pattern from the mold, the elastic portion is deformed by the resistance of the hardened mold material so that no destruction of the resulting back draft portion occurs. The deformation of the elastic portion by the action of the hardness of the mold material requires however a high degree of stability and hardness of the mold materials, so that this tool can be used to form back drafts only in hardened molding materials. Yet compared to the making of molds from loose molding materials wherein the final compacting is achieved by pressing, mold making using hardened molding materials is considered more laborious and expensive.

SUMMARY OF THE INVENTION

It is therefore an object of the present invention to provide a mold forming tool for economical manufacture of molds by a simple mold-forming process from loose molding materials as well, for the casting of articles presenting undercuts, so that economical mass production is possible.

The invention particularly relates to the manufacture of molds for the casting of slide- and/or counter-rings of axial face seals of cast iron or steel of the type having at their outer circumference, a support collar, shaped as an undercut, for an elastic O-ring.

According to the invention, this object is achieved by providing such a tool with an elastically deformable portion in the region where an undercut is to be formed such that it is deformable, thus creating the undercut, simply under the influence of the pressure applied during the final compacting of the molding material. On relieving the pressing force imposed on the tool during compression of the mold material the elastic portion thereof moves back due to its elastic resistance without requiring any externally applied force, to its unstressed rest condition, so that the resulting undercut hollow section of the mold is not destroyed even in the less stable and softer mold materials which has been shaped simply by compaction.

The shape of the elastic portion of the tool depends on the size and location of the undercut hollow section of the mold to be formed. It must be determined empirically by molding experiments. If necessary, the pressure of the loose molding material acting on the elastic portion of the tool may be increased by insertion of auxiliary pattern portions into the tool so that the deformation occurs in the desired direction.

Since the invention is mainly related to mold forming tools for the manufacture of molds for the casting of slide- and/or counter-rings of axial face seals in mass production, whose undercuts define support collars at the upper rim of the outer circumference, the elastically deformable portion of the tool is composed of an annular bearing preferably made of an elastomer and disposed at the upper border of the tool. By proper selection of the elastomer quality and cross-sectional shape in combination with the form of the rigid base portion of the tool, one-side or double-side undercuts may be created in the mold. The form tool according to the invention may, however, also be used for the manufacture of casting molds for the casting of cast parts having undercuts in other regions. If, for example, the undercuts are situated in the middle part of the casting, the middle part of the tool may correspondingly be made elastically deformable.

The invention thus provides a mold forming tool which renders it feasible to manufacture, by compression molding of loose molding material, molds for the casting of cast pieces having undercuts. In particular, the invention makes possible an economical mass production of annular articles such as slide- and/or counter-rings for axial face seals, and of piston rings, valve seat rings, etc., as well.

DESCRIPTION OF THE PREFERRED EMBODIMENTS

Figure 1:
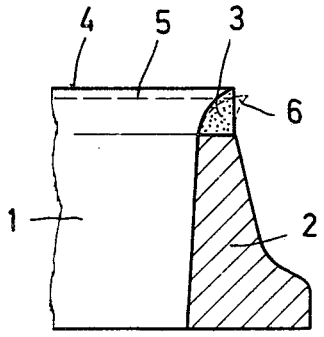
FIG. 1 is a cross-sectional detail view of a part of a tool for the production of a slide-ring for an axial face seal, according to a preferred embodiment of the invention.

FIG. 1 shows a mold forming tool, or pattern, 1 according to the invention, with a rigid portion 2 and a rubber top 3 having sides which meet at an acute angle. In its unstressed rest condition, the portion 3 has the form shown in solid lines and reaches up to line 4. Under stress, i.e. when pressed into loose molding material, the portion 3 is deformed or deflected into the broken-line configuration and thus extends up only as far as line 5. Because of the inherent incompressibility of the rubber material, a radial-outwardly directed bulge 6 creating the undercut is formed. In the embodiment of FIG. 1, portion 3 has the form of a rim or lip.

Figure 2:
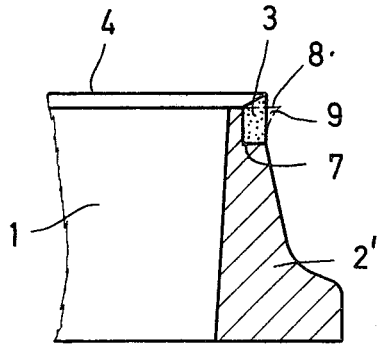
FIGS. 2–4 are views similar to that of FIG. 1 of further embodiments of the tools according to the invention.

In FIG. 2, the rubber portion 3' is partly inserted into a recess 7 of the rigid portion 2' of the tool in such a manner that the lip 3', during deformation down to line 8, is deformed outwardly in the shape illustrated by 9. Line 8 coincides with the upper rim of the rigid portion 2' of the form tool, so that a well-defined deformation of the lip 3' is achieved.

Figure 3:
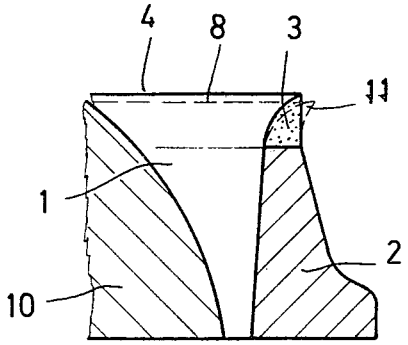

In FIG. 3, the tool includes a pattern insert 10 shaped in a manner such that the loose molding material, while being pressed in, is forced into the direction of the lip 3, thereby pressing it radially outwardly into a shape illustrated by 11.

Figure 4:
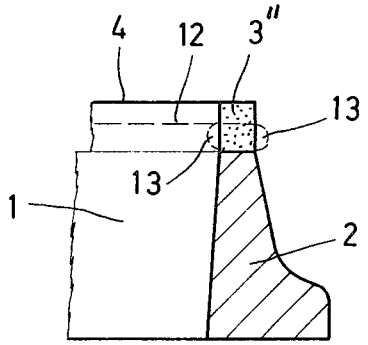

In FIG. 4, the portion 3'' has a rectangular cross section. By deformation down to line 12, the portion 3'' is deformed and vaulted, as shown by its protruding parts 13, on both sides in both the inward and outward directions, so that in the resulting casting an undercut is formed on both sides at the inner and outer circumferences thereof.

It will be appreciated that the precise shape assumed by the deformable portion during mold material compression will depend on its unstressed shape, the hardness of the elastomer and the influence of added inserts, such as the insert 10 of FIG. 3. One can therefore arrive at a specific desired shape on the basis of experience and a certain amount of trial and error.

It will be understood that the above description of the present invention is susceptible to various modifications, changes and adaptations, and the same are intended to be comprehended within the meaning and range of equivalents of the appended claims.

What is claimed is:

1. A process for the manufacture of a casting mold for cast pieces having at least one undercut, comprising:

(a) embedding in a mass of loose mold forming material a tool having an elastically deformable portion in the region of such undercut, which portion does not present the shape of an undercut portion when unstressed by the mold material and is constructed to be deformed to create an undercut portion in the mold material when stressed by the mold material, the elastically deformable portion being made of a material which is deformable solely under the influence of pressure exerted on the mold forming material during compacting;

(b) applying pressure for simultaneously deforming said elastically deformable portion of said tool to cause that portion to present the shape of the undercut and compacting said mold forming material to form the mold; and (c) removing said tool from the resulting mold, thus creating a mold recess in the shape of said tool when said elastically deformable portion is in its deformed state.

2. A process as defined in claim 1 wherein said elastically deformable portion comprises an elastomer body.

3. A process as defined in claim 2 wherein the tool further includes a rigid member having a recess, with said elastomer body being embedded in said recess.

4. A process as defined in claim 1 further comprising positioning at least one insert to direct loose mold forming material, during compression thereof, in a manner to increase the deformation of the elastically deformable portion in a desired direction.

* * * * *